US008919243B2

(12) United States Patent
Kang et al.

(10) Patent No.: US 8,919,243 B2
(45) Date of Patent: Dec. 30, 2014

(54) COOKING APPLIANCE

(75) Inventors: Myeong-Yeol Kang, Seoul (KR); Eun Hyae Han, Seoul (KR)

(73) Assignee: LG Electronics Inc., Seoul (KR)

( * ) Notice: Subject to any disclaimer, the term of this patent is extended or adjusted under 35 U.S.C. 154(b) by 607 days.

(21) Appl. No.: 13/263,948

(22) PCT Filed: Sep. 3, 2009

(86) PCT No.: PCT/KR2009/004954

§ 371 (c)(1),
(2), (4) Date: Oct. 11, 2011

(87) PCT Pub. No.: WO2010/131800

PCT Pub. Date: Nov. 18, 2010

(65) Prior Publication Data

US 2012/0024167 A1 Feb. 2, 2012

(30) Foreign Application Priority Data

May 11, 2009 (KR) ..... 10-2009-0041001

(51) Int. Cl.
*A47J 37/10* (2006.01)
*F24C 15/20* (2006.01)

(52) U.S. Cl.
CPC ..... *F24C 15/2042* (2013.01)
USPC ..... 99/425; 99/458; 99/459; 99/460; 99/461; 99/467; 99/521; 99/324; 99/328; 99/356; 126/19 R; 126/21 R; 126/299 R; 126/317

(58) Field of Classification Search
CPC ..... A47J 36/38; A47J 37/06; A47J 37/0611; F24C 15/20; F24C 15/2042; F24C 15/2021; F24C 7/08; F24C 3/103; F24C 3/126; F24C 3/085; F24D 2220/06; F24D 14/06; F24D 2220/02; F24D 2220/08; F24D 2220/2009; F24D 2220/2081; F24D 2220/209; F24D 2240/10; H01H 3/0206
USPC ..... 126/299 R–317, 19 R–21 R, 31; 219/702; 99/425, 458–521, 324–356; 454/49
See application file for complete search history.

(56) References Cited

U.S. PATENT DOCUMENTS 762,797 A * 6/1904 Bishop ..... 126/20.2
1,053,837 A * 2/1913 Leonard ..... 126/1 D
1,217,678 A * 2/1917 Andrews ..... 126/53

(Continued)

FOREIGN PATENT DOCUMENTS

CN 201003809 Y * 1/2008
JP 10-248723 A 9/1998

(Continued)

*Primary Examiner* — Brett Spurlock
(74) *Attorney, Agent, or Firm* — Birch, Stewart, Kolasch & Birch, LLP

(57) ABSTRACT

Provided is a cooking appliance. The cooking appliance includes a cooktop part on which a grill module for grill cooking is detachably disposed, a collection device for sucking an exhaust gas generated in the grill module, an exhaust device forcibly sucking the exhaust gas collected into the collection device to exhaust the exhaust gas to the outside, and a guide device for guiding the exhaust gas collected into the collection device to the exhaust device. The cooking appliance enables different types of food to be simultaneously cooked according to different cooking methods, and thus cooking time for food may be reduced and various demands of users may be met.

12 Claims, 6 Drawing Sheets

(56) References Cited

U.S. PATENT DOCUMENTS

| | | | | | |
|---|---|---|---|---|---|
| 1,305,647 | A | * | 6/1919 | Elliott | 126/53 |
| 1,659,064 | A | * | 2/1928 | Waters | 126/20.2 |
| 2,030,519 | A | * | 2/1936 | Hamilton | 126/215 |
| 2,059,133 | A | * | 10/1936 | Merritt | 99/339 |
| 2,095,745 | A | * | 10/1937 | Hiatt | 126/2 |
| 2,099,788 | A | * | 11/1937 | Ames | 126/275 R |
| 2,254,271 | A | * | 9/1941 | Cretors | 99/323.9 |
| 2,396,924 | A | * | 3/1946 | Paul Monath | 366/283 |
| 3,016,817 | A | * | 1/1962 | Persinger et al. | 99/339 |
| 3,098,924 | A | * | 7/1963 | Salton et al. | 219/387 |
| 3,099,202 | A | * | 7/1963 | Palmer | 99/337 |
| 3,172,999 | A | * | 3/1965 | Sutton et al. | 219/524 |
| 3,598,962 | A | * | 8/1971 | Badnaruk et al. | 219/452.13 |
| 3,682,157 | A | * | 8/1972 | Perl | 126/37 B |
| 3,790,391 | A | * | 2/1974 | Bolleter et al. | 99/330 |
| 3,823,661 | A | * | 7/1974 | Kells | 99/468 |
| 3,923,037 | A | * | 12/1975 | Donato | 126/39 C |
| 3,968,785 | A | * | 7/1976 | Perl | 126/39 J |
| 4,036,994 | A | * | 7/1977 | Ear | 426/233 |
| 4,108,138 | A | * | 8/1978 | Petin et al. | 126/19 R |
| 4,149,455 | A | * | 4/1979 | Ross | 99/323.5 |
| 4,151,792 | A | * | 5/1979 | Nearhood | 99/348 |
| 4,160,002 | A | * | 7/1979 | Janovtchik | 261/76 |
| 4,468,548 | A | * | 8/1984 | Yamaki | 219/601 |
| 4,481,404 | A | * | 11/1984 | Thomas et al. | 219/398 |
| 4,562,827 | A | * | 1/1986 | Cerola | 126/299 R |
| 4,643,167 | A | * | 2/1987 | Brewer | 126/299 R |
| 4,884,554 | A | * | 12/1989 | Yanagida | 126/21 R |
| 4,939,986 | A | * | 7/1990 | Turner | 454/347 |
| 4,962,694 | A | * | 10/1990 | Graver | 99/339 |
| 5,038,747 | A | * | 8/1991 | Tsuchiya et al. | 126/19 R |
| 5,078,122 | A | * | 1/1992 | Kalenian | 126/299 R |
| 5,139,007 | A | * | 8/1992 | Bertomeu Martinez | 126/39 J |
| 5,445,061 | A | * | 8/1995 | Barradas | 99/340 |
| 5,446,268 | A | * | 8/1995 | Chen | 219/623 |
| 5,671,726 | A | * | 9/1997 | Hsu | 126/299 D |
| 5,743,173 | A | * | 4/1998 | Hayashi et al. | 99/331 |
| 5,836,297 | A | * | 11/1998 | Kawasaki | 126/299 D |
| 6,072,169 | A | * | 6/2000 | Kang et al. | 219/702 |
| 6,172,338 | B1 | * | 1/2001 | Barnes et al. | 219/399 |
| 6,191,391 | B1 | * | 2/2001 | Deo et al. | 219/407 |
| 6,293,276 | B1 | * | 9/2001 | Owens et al. | 126/299 D |
| 6,322,352 | B1 | * | 11/2001 | Zink | 431/27 |
| 6,393,971 | B1 | * | 5/2002 | Hunot et al. | 99/341 |
| 6,415,708 | B2 | * | 7/2002 | Huber et al. | 99/348 |
| 6,526,873 | B2 | * | 3/2003 | Brady | 99/332 |
| 6,719,622 | B2 | * | 4/2004 | Peng | 454/67 |
| 6,761,159 | B1 | * | 7/2004 | Barnes et al. | 126/21 R |
| 6,886,554 | B2 | * | 5/2005 | Cheng | 126/299 D |
| 6,998,582 | B1 | * | 2/2006 | Maroti | 219/451.1 |
| 7,301,128 | B2 | * | 11/2007 | Li et al. | 219/450.1 |
| 7,442,119 | B2 | * | 10/2008 | Fluhrer | 454/67 |
| 7,954,485 | B2 | * | 6/2011 | Cadima et al. | 126/21 R |
| 2003/0159802 | A1 | * | 8/2003 | Steneby et al. | 165/59 |
| 2006/0191895 | A1 | * | 8/2006 | Li et al. | 219/497 |
| 2007/0062513 | A1 | * | 3/2007 | Gagas | 126/299 D |
| 2007/0074713 | A1 | * | 4/2007 | Cadima et al. | 126/21 R |
| 2007/0102426 | A1 | * | 5/2007 | Braunisch et al. | 219/757 |
| 2007/0169718 | A1 | * | 7/2007 | Conger et al. | 119/455 |
| 2007/0199558 | A1 | * | 8/2007 | Kobayashi | 126/39 E |
| 2007/0221199 | A1 | * | 9/2007 | Hake et al. | 126/299 R |
| 2008/0092754 | A1 | * | 4/2008 | Noman | 99/443 |
| 2008/0142503 | A1 | * | 6/2008 | Li et al. | 219/450.1 |
| 2008/0184986 | A1 | * | 8/2008 | Kohlstrung | 126/273.5 |
| 2011/0250336 | A1 | * | 10/2011 | Ewald et al. | 426/511 |
| 2012/0031283 | A1 | * | 2/2012 | Kang et al. | 99/339 |

FOREIGN PATENT DOCUMENTS

| | | | | |
|---|---|---|---|---|
| JP | 10248723 | A | * | 9/1998 |
| KR | 20-1998-023213 | U | | 7/1998 |
| KR | 10-2005-0097713 | A | | 10/2005 |
| KR | 10-0666242 | B1 | | 1/2007 |

* cited by examiner

COOKING APPLIANCE

CROSS-REFERENCE TO RELATED APPLICATIONS

The present application claims priority under 35 U.S.C. 119 and 35 U.S.C. 365 to Korean Patent Application No. 10-2009-0041001 (filed on May 11, 2009), which is hereby incorporated by reference in its entirety.

BACKGROUND

The present disclosure relates to a cooking appliance, sand more particularly, to a cooking appliance which cooks a food using a grill.

Cooking appliances are one of home appliances which heat a food to be cooked to cook the food so that a user eats the food.

Such a cooking appliance may be classified according to a kind of heating sources for heating a food to be cooked or an installed form of the heating sources.

When the cooking appliance is classified according to a kind of heating sources for heating a food to be cooked, the cooking appliance may be classified into a microwave oven which a high frequency is supplied into a sealed space for receiving a food to heat the food and an oven in which air within a sealed space for receiving a food is heated to cook the food.

Also, the cooking appliance may be classified into a gas cooking appliance in which a food is heated using fire generated by burning a gas supplied according to the kind of heating sources for heating the food to be cooked and an electric cooking appliance in which a food is heated using a heater generating heat by the supplied electricity.

When the cooking appliance is classified according to the installed form, the cooking appliance may be classified into a built-in type cooking appliance which is installed between kitchen furniture installed in a kitchen space, a free-stand type cooking appliance which is installed at a position desired by a user, and a wall-mountable cooking appliance which is installed on a predetermined wall in a kitchen space.

In recent, various functions are being added to the cooking appliance to satisfy various needs of the user. For example, the various functions may include a function in which heating sources are multiply installed to reduce a cooking time for cooking a food, an insulation function in which the cooking appliance is built in cooking furniture to improve safety, and a function in which a passage for exhausting an exhaust gas generated during the cooking of the food and a passage for cooling the product are reconstituted.

SUMMARY

Embodiments provide a cooking appliance which is capable of cooking a food in various methods.

Embodiments also provide a cooking appliance which is capable of cooking a food using a grill and being safely controlled.

In one embodiment, a cooking appliance includes: a cooktop part on which a grill module for grill cooking is detachably disposed; a collection device for sucking an exhaust gas generated in the grill module; an exhaust device forcibly sucking the exhaust gas collected into the collection device to exhaust the exhaust gas to the outside; and a guide device for guiding the exhaust gas collected into the collection device to the exhaust device.

The details of one or more embodiments are set forth in the accompanying drawings and the description below. Other features will be apparent from the description and drawings, and from the claims.

DETAILED DESCRIPTION OF THE EMBODIMENTS

Hereinafter, a cooking appliance according to an embodiment will be described in detail with reference to the accompanying drawings.

The invention may, however, be embodied in many different forms and should not be construed as being limited to the embodiments set forth herein; rather, that alternate embodiments included in other retrogressive inventions or falling within the spirit and scope of the present disclosure can easily be derived through adding, altering, and changing, and will fully convey the concept of the invention to those skilled in the art.

Although a gas oven is described for convenience of description as an example, the present disclosure is not limited thereto. For example, various cooking appliances may be applied to the embodiment.

Also, since terms used in the specification or claims are concepts selected for convenience of description, it should be interpreted as meanings suitable for the spirit and scope of the present disclosure in order to most appropriately comprehend technical contents of the present disclosure.

Figure 1:
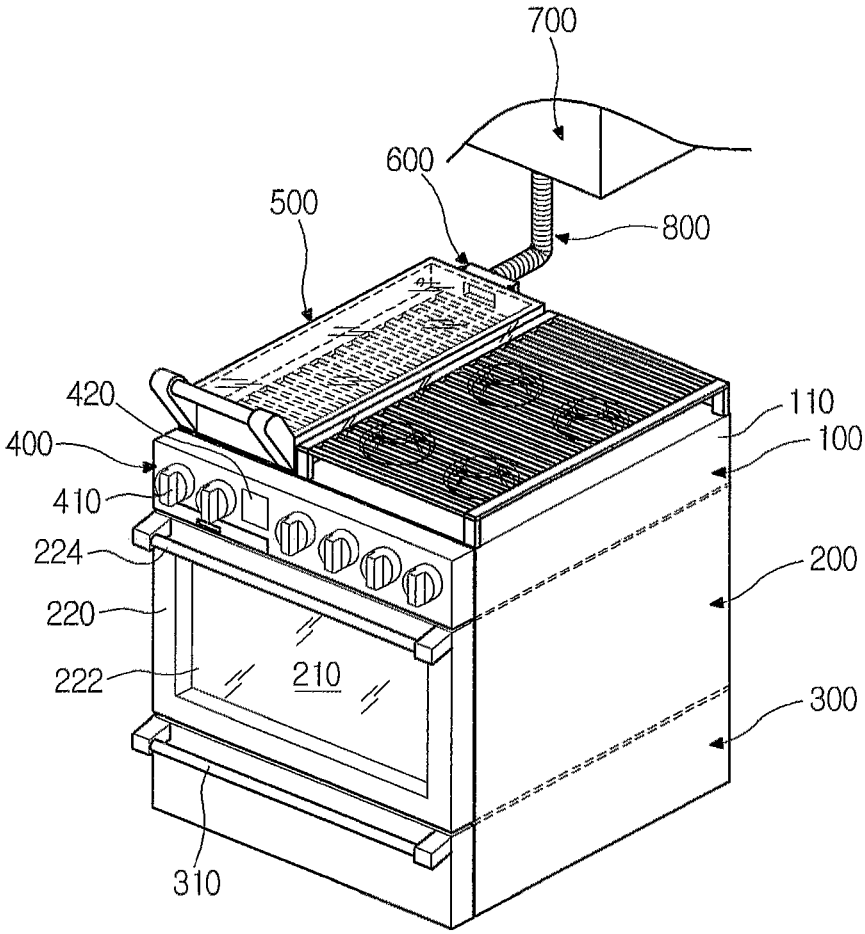
FIG. 1 is a perspective view of a cooking appliance according to an embodiment.
Figure 2:
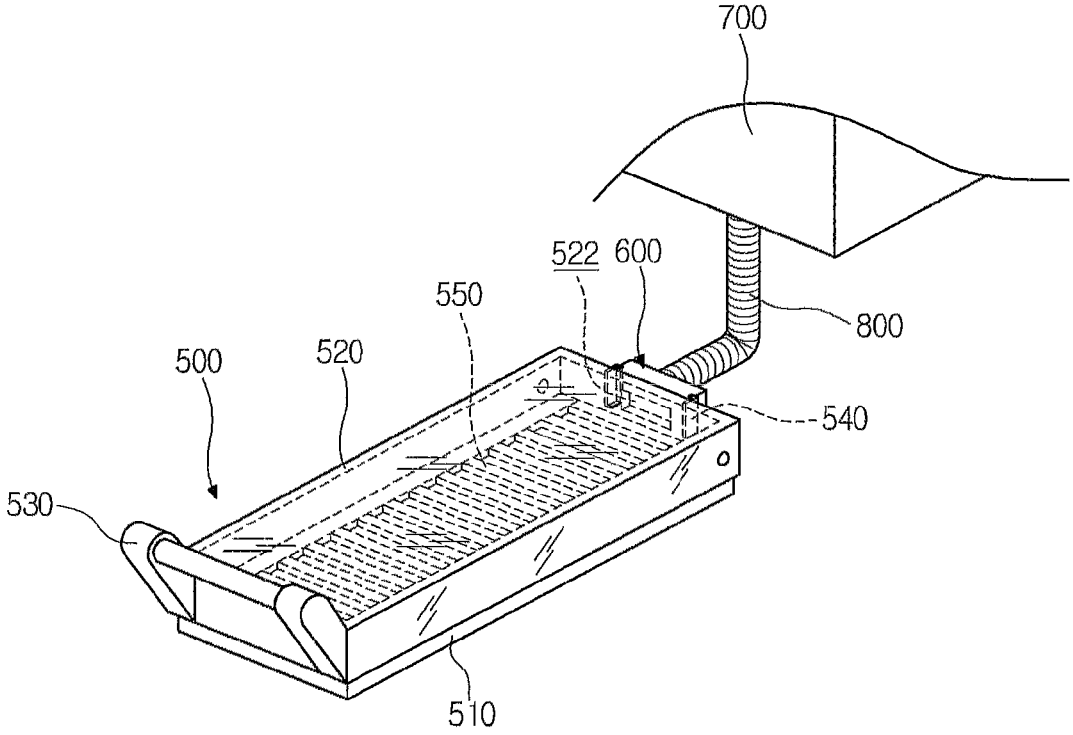
FIG. 2 is a perspective view illustrating a grill module of a cooking appliance according to an embodiment.

FIG. 1 is a perspective view of a cooking appliance according to an embodiment. FIG. 2 is a perspective view illustrating a grill module of a cooking appliance according to an embodiment.

Figure 3:
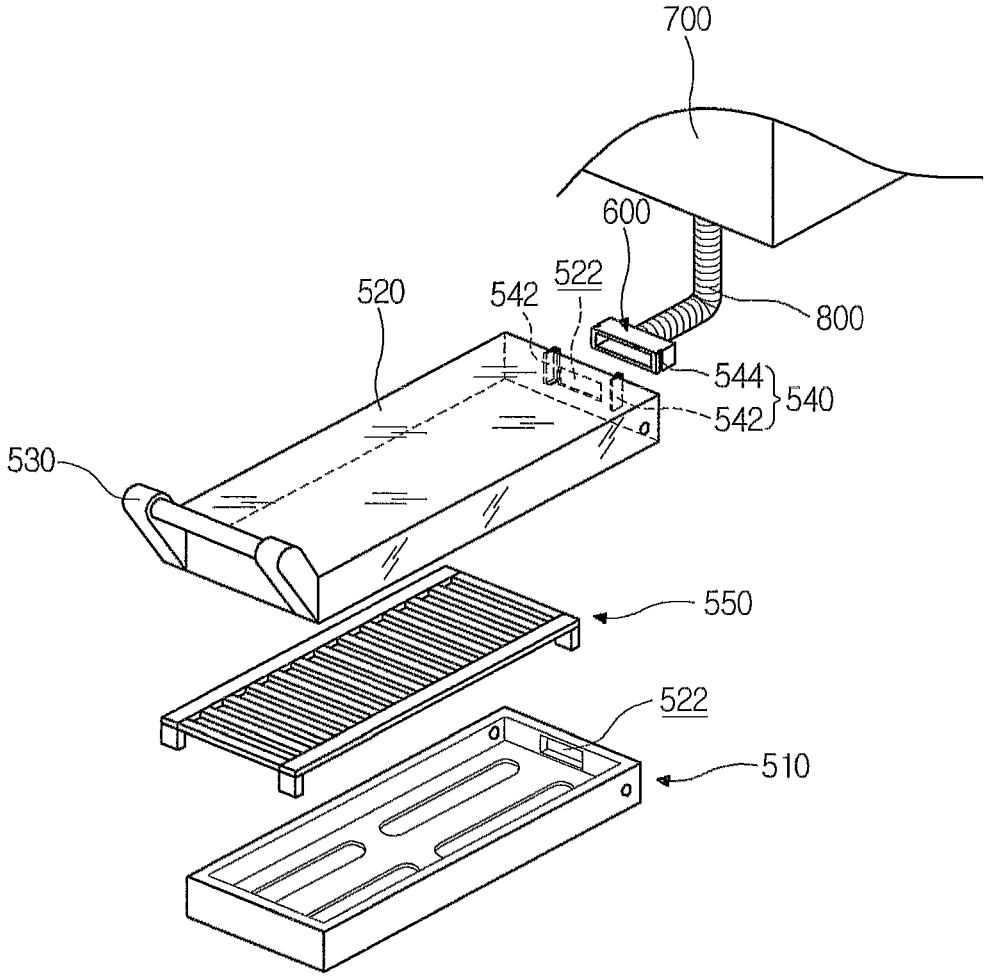
FIG. 3 is an exploded perspective view illustrating a grill module of a cooking appliance according to an embodiment.
Figure 4:
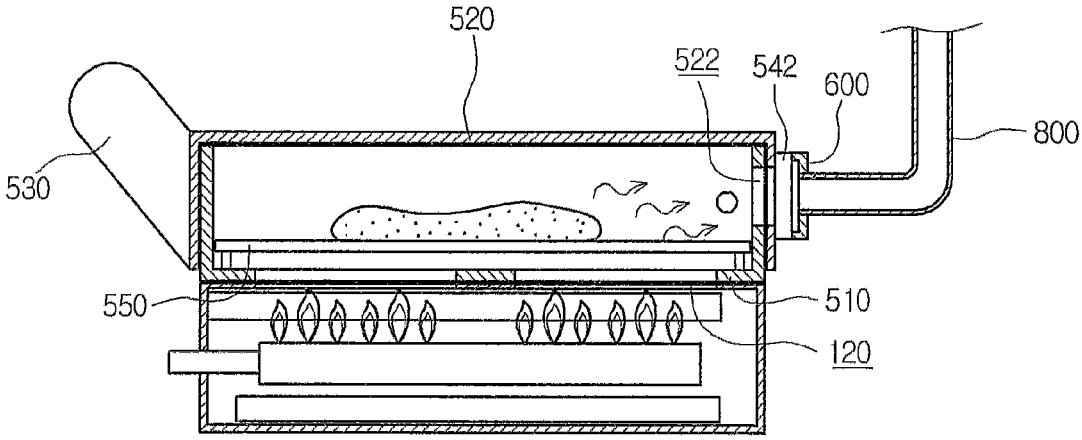
FIG. 4 is a side-sectional view illustrating a direct heating portion of a cooking appliance according to an embodiment.

FIG. 3 is an exploded perspective view illustrating a grill module of a cooking appliance according to an embodiment. FIG. 4 is a side-sectional view illustrating a direct heating portion of a cooking appliance according to an embodiment.

Figure 5:
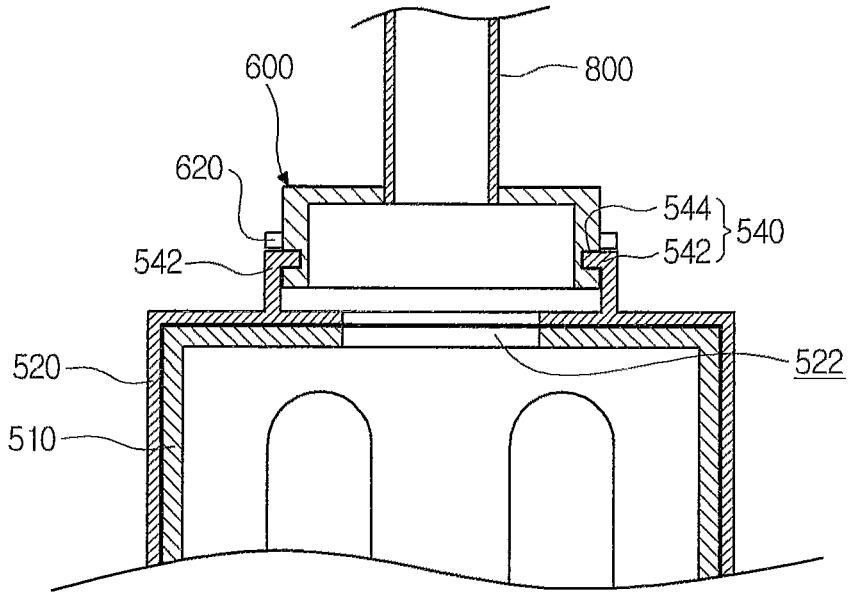
FIG. 5 is a partial enlarged sectional view of a state in which a grill module and a collection device of a cooking appliance are coupled to each other according to an embodiment.
Figure 6:
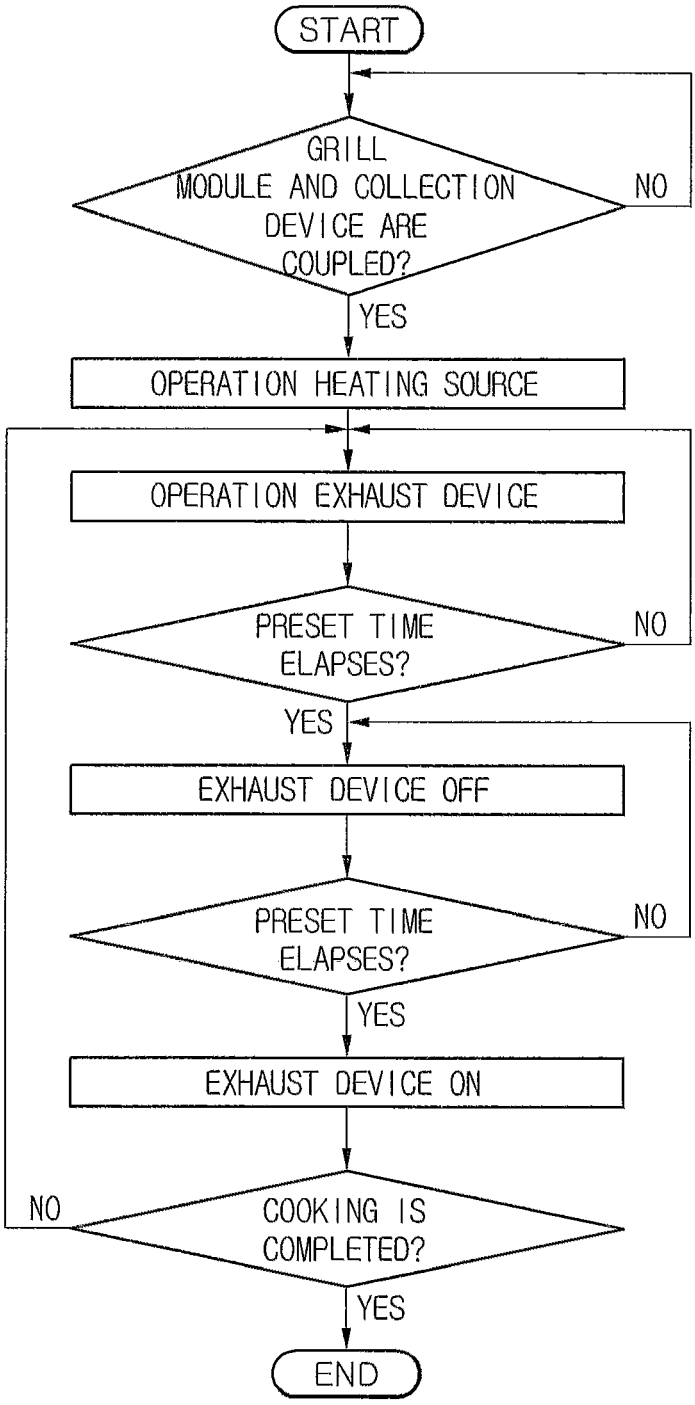
FIG. 6 is a block diagram illustrating an operation process of a cooking appliance according to an embodiment.

FIG. 5 is a partial enlarged sectional view of a state in which a grill module and a collection device of a cooking appliance are coupled to each other according to an embodiment. FIG. 6 is a block diagram illustrating an operation process of a cooking appliance according to an embodiment.

Hereinafter, a gas oven range according to an embodiment will be described as example in detail with reference to the accompanying drawings.

A cooking appliance according to an embodiment has an approximately rectangular parallelepiped shape on the whole. A cooktop part 100 in which a food placed on a top surface thereof or a container containing a food is heated to cook the food is disposed at the uppermost position of the cooking appliance.

An oven part 200 in which a food is received in an inner space thereof to heat the inner space in which the food is received using a plurality of heating sources, thereby cooking the food, is disposed under the cooktop part 100. A drawer part 300 for storing the cooked food in a warm state or heating the food at a low temperature to cook the food is disposed under the oven part 200.

The cooktop part 100 has an approximately rectangular parallelepiped shape on the whole and defines a predetermined inner space. The plurality of heating sources for heating the food placed at an upper side of the inner space are disposed in the inner space of the cooktop part 100.

A top surface of the cooktop part 100 is defined by a top plate. The top plate has a square plate shape with a predetermined thickness. Also, the top plate is formed of a ceramic material having high heat resistance. The top plate transmits heat generated by fire emitted form the plurality of heating sources mounted in the inner space of the cooktop part 100 into the food placed on the upper side or the container containing the food.

The cooktop part 100 may be divided into a portion at which the container containing the food placed on the upper side is heated to cook the food and a portion at which the food placed on the upper side is heated and cooked. Here, the portion in which the container containing the food is heated to cook the food will be referred to as an indirect heating portion, and the portion in which the food is heated and cooked will be referred to as a direct heating portion.

Although the food may be directly heated and cooked at the indirect heating portion without heating the container containing the food, since the container containing the food is frequently heated to cook the food at the indirect heating portion, the portion in which the container containing the food is heated to cook the food will be referred to as the indirect heating portion.

When viewed in drawings, a left portion of the cooktop part 100 may be the direct heating portion in which the food is directly heated and a right portion may be the indirect heating portion in which the container containing the food is heated to cook the food.

A support member for supporting the container containing the food is disposed on the indirect heating portion. The container is disposed on a top surface of the support member. Then, the container is heated by fire generated from the heating source disposed under the support member.

A control part 400 for controlling the cooktop part 100, the oven part 200, and the drawer part 300 is disposed on a front surface of the cooktop part 100. The control part 400 includes a manipulation part 410 for directly manipulating the heating source when the food is cooked using the cooktop part 100, the oven part, and the drawer part 300 in a plurality of knob shapes and a display part 420 for displaying an image or a sound signal so that the user confirms operation states of the cooktop part 100, the oven part 200, and the drawer part 300.

The manipulation part 410 may be provided to directly manipulate the plurality of heating sources by the user. The manipulation part 410 may be provided in various shapes, e.g., in a button shape or wheel shape, but the knob shape. That is, the manipulation part 410 may have any shape if the user can manipulate the plurality of heating sources.

The oven part 200 is disposed under the cooktop part 100. The oven part 200 has an approximately rectangular parallelepiped shape on the whole. A cavity 210 providing a space in which the food is cooked is defined in an inner space thereof. The plurality of heating sources are disposed outside the cavity 210.

As described above, since the inner space of the cavity 210 is heated by the plurality of heating sources disposed outside the cavity 210, the food disposed in the inner space of the cavity 210 is heated by hot air within the cavity 210 to cook the food.

The cavity 210 has the inner space and a rectangular parallelepiped shape with an opened front side. A food to be cooked or the cooked food may be accessible between the inner space and an outer space through the opened front side. An oven door 220 for selectively opening or closing the inner space of the cavity 210 is rotatably disposed on a front surface of the oven part 200.

The oven door 220 has a square plate shape with a predetermined thickness. A viewing window 222 for confirming a cooking state or an operation state of the food received in the inner space of the cavity 210 without rotating the oven door 220 by the user is disposed in a central portion of the oven door 220.

A door handle 224 grasped by the user when the user rotates the oven door 220 is disposed on a front surface of the oven door 220 to easily rotate the oven door 220. The door handle 224 may protrude forward from the front surface of the oven door 220. Alternatively, the door handle 224 may be recessed backward so that the user easily grasps the door handle 224.

That is, if the door handle 224 has a shape which is easily grasped by the user when the oven door 220 is rotated, the door handle 224 may have any shape. Since the cavity 210 may provide a space in which the food is cooked therein, the cavity may have any shape if the cavity provides a space capable of cooking the food.

Also, the drawer part 300 has a rectangular parallelepiped shape with an opened front side. The heating sources for heating the inner space of the drawer part 300 are disposed under the drawer part 300 or on a bottom surface of the drawer part 300. The heating sources may be provided in plurality and also have various shapes.

The drawer part 300 may be slidably disposed forward and backward so that the user takes the food or the container containing the food into the inner space to cook the food after the drawer part 300 is slid forward by the user. A drawer handle 310 grasped by the user when the user slides the drawer part 300 is disposed on the front surface of the drawer part 300.

Also, a grill module 500 for directly heating the food to cook the food is disposed at the direct heating portion of the cooktop part 100. The grill module 500 is disposed above the top plate at the direct heating portion when the user directly cooks the food using a grill.

The grill module 500 provides a cooking space for food. The grill module 500 includes a module body 510 providing a space for receiving a module support member 550 and a module cover 520 for selectively opening or closing at least top surface of the module body 510.

The module body 510 has a rectangular parallelepiped shape with an opened upper side. Also, the module body 510 has a predetermined inner space. In addition, the module cover 520 has a rectangular parallelepiped shape with an opened lower side. Also, the module cover 520 has a predetermined inner space.

The module cover 520 may be formed of a glass, aluminum, or iron plate. Also, the module cover 520 may have a transparent or semitransparent material so that the user easily confirms the cooked state of the food in the inner space of the grill module 500 from the outside.

The grill module 500 may be detached from the cooktop 100. When the container containing the food is heated at the direct heating portion without using the drill module 500, the grill module 500 is separated from the cooktop part 100 and then a support member for supporting the container containing the food is disposed on the direct heating portion. Then, when the plurality of heating sources disposed in the inner space of the cooktop part 100 is operated after the container is disposed on a top surface of the support member, the food contained in the container may be cooked.

An exhaust device 700 for forcibly sucking an exhaust gas to exhaust the exhaust gas to the outside is disposed above the cooktop part 100. A guide device 800 for guiding the exhaust gas into the exhaust device 700 is disposed in the cooktop part 100, i.e., between the grill module 500 and the exhaust device 700.

Also, a collection device 600 for collecting the exhaust gas generated when the food is cooked in the inner space of the grill module 500 is disposed at an end portion of the guide device 800, i.e., at a portion coupled to the grill module 500.

Thus, when the user directly cooks the food using the grill module 500, the exhaust gas is generated in the inner space of the grill module 500. The exhaust gas may pass through the guide device 800 in the inner space of the grill module 500 and be moved into the inner space of the exhaust device 700. Then, the exhaust gas is moved to the outside of the kitchen space by the operation of the exhaust device 700.

FIG. 2 is a perspective view illustrating a grill module of a cooking appliance according to an embodiment. FIG. 3 is an exploded perspective view illustrating a grill module of a cooking appliance according to an embodiment.

Referring to FIGS. 2 and 3, in the grill module 500 and a flow of the exhaust gas, the grill module 500 includes the module body 510 defining an inner space and supporting the food, the module cover 520 for selectively opening or closing at least top surface of the module body 510, and the module support member 550 supporting the food to be cooked.

The module body 510 has a square box shape with an opened top side. The module support member 550 is seated in the inner space of the module body 510. The module cover 520 for selectively opening or closing the at least top surface of the module body 510 is disposed above the module body 510.

The module cover 520 has a square box shape with an opened lower side. The module cover may be formed of a transparent or semitransparent material so that the user confirms a state of the food to be cooked using the grill module 500 from the outside.

Thus, the inner space of the grill module 500 is defined by the inner space of the module body 510 and the inner space of the module cover 520. The food to be cooked is placed in the inner space and then heated and cooked.

An exhaust hole 522 providing a passage through which the exhaust gas generated when the food is cooked in the inner space of the grill module 500 is moved to the outside is defined in a rear surface of the grill module 500.

The rear surface of the grill module 500 is punched to define the exhaust hole 522 having a predetermined area. The exhaust gas generated in the inner space of the grill module 500 is moved to the outside of the grill module 500 through the exhaust hole 522.

The exhaust hole 522 may be selectively opened or closed by the user. That is, an exhaust hole cover (not shown) having a sectional area greater than that of the exhaust hole is disposed to selectively open or close the exhaust hole 522.

A module handle 530 protrudes forward from a front surface of the module cover 520 so that the user grasps the module cover 520 when the inner space of the grill module 500 is selectively opened or closed.

Since the module handle 530 is easily grasped by the user to rotate the module cover 520, the module handle 530 may have various shapes if the module handle 530 provides the same function.

A coupling part 540 for coupling the collection device 600 (that will be described below in detail) to the grill module 500 is disposed on a rear surface of the grill module 500. When the collection device 600 is coupled to the coupling part 540, a front surface (when viewed in drawings) of the collection device 600 and the rear surface of the grill module 500 are coupled to each other with a predetermined distance therebetween.

This is done for a reason in which air is moved from the inner space of the grill module 500 into the exhaust device 700 by a suction force generated in the exhaust device 700 and then it prevents fire generated from a grill heating source disposed in the inner space of the cooktop part 100 from being extinguished or incompletely burned to uniformly heat the food.

The coupling part 540 includes a coupling projection 542 disposed on the rear surface of the grill module 500 and coupling grooves 544 defined in both side surfaces of the collection device 600. The coupling projection 542 protrudes backward from the rear surface of the grill module 500. Also, a rear end of the coupling projection 542 is bent inward to extend, thereby form a square plate shape having a predetermined thickness.

The coupling projection 542 may be spaced a predetermined distance from a left side of the exhaust hole 522. The coupling projection 542 is received into the coupling groove 544 defined in the collection device 600 along the bent portion of the coupling projection 542 and thus is coupled to the grill module 500.

That is, when the collection device 600 is moved from an upper side to a lower side between the coupling projections 542, the bent portion of the coupling projection 542 is received into the coupling groove 544 defined in both side surfaces of the collection device 600. As a result, the collection device 600 is coupled to the grill module 500.

In detail, when viewed from an upper side of the coupling projection 542, the coupling projection 542 has an approximately "⌈ ⌉" shape. Also, when viewed from an upper side of the coupling groove 544, the coupling groove 544 has an approximately "⊃ ⊂" shape. The bent portion of the coupling projection 542 is received into the coupling groove 544 and coupled to the coupling groove 544.

A stopper (not shown) for restricting the downward movement of the collection device 600 is further disposed on a lower end of the coupling projection 542. A rib having a predetermined strength protrudes inward from the lower end of the coupling projection 542 to form the stopper.

That is to say, a rib having a predetermined strength protrudes from the lower end of the bent portion of the coupling projection 542 to contact a bottom surface of the collection device 600, thereby restricting the downward movement of the collection device 600.

A detection part 620 for detecting the coupling of the collection device 600 and the grill module 500 is disposed on a side of the coupling groove 544 of the collection device 600. A sensor or switch having various shapes may be used as the detection part 620. The detection part 620 detects whether the collection device 600 and the grill module 500 are coupled to each other and transmits the detected result into the control part 400.

When the control part 400 receives the detected result with respect to the coupling of the collection device 600 and the grill module 500 by the detection part 620, the control part 400 transmits a signal into the manipulation part 410 to control an operation of the heating source disposed under the grill module 500, i.e., at a left side (when viewed in the drawings) within the inner space of the cooktop part 100.

As described above, that the heating source is operated only in the state where the collection device 600 and the grill module 500 are coupled to each other is for a reason in which the user does not cook the food using the grill module 500 if the collection device 600 and the grill module 500 are not coupled to each other.

If the user cooks the food using the grill module 500 in the state where the collection device 600 and the grill module 500 are not coupled to each other, the exhaust gas generated during the cooking of the food may be exhausted into the kitchen space to contaminate the kitchen space. Thus, to prevent the kitchen space from being contaminated, the food is cooked using the grill module 500 only when the collection device 600 and the grill module 500 are coupled to each other.

The module support member 550 for supporting the food is received in the inner space of the grill module 500. At least one portion of the bottom surface of the grill module 500 is opened. As described above, that the at least one portion of the bottom surface of the grill module 500 is opened is for a reason in which fire and/or heat generated from the heating source disposed in the inner space of the cooktop part 100 is(are) directly emitted into the inner space of the grill module 500.

Thus, when the fire and/or heat is(are) emitted from the heating source disposed in the inner space of the cooktop part 100, the fire and/or heat may pass through a heating hole defined in the top plate to heat the food disposed on the top surface of the module support member 550 disposed in the inner space of the grill module 500 through the opened portion of the bottom surface of the grill module 500.

When the food disposed in the inner space of the grill module 500 is heated, an exhaust gas is generated. The exhaust gas is collected into the collection device 600 by passing through the exhaust hole 522.

The exhaust gas collected into the collection device 600 is guided by the guide device 800 and moved into the inner space of the exhaust device 700. The exhaust gas moved into the inner space of the exhaust device 700 is exhausted to the outside of the kitchen space.

Here, the exhaust device 700 is operated for a preset time and then stopped for a preset time. The time control of the exhaust device 700 for the preset time is for a reason in which the exhaust gas flows into the inner space of the grill module 500 for a predetermined time to allow the exhaust gas to be soaked into the food.

As described above, when the exhaust gas is soaked into the food, the user may feel delicious taste of the cooked food in sense of small.

Hereinafter, an operation of the cooking appliance according to an embodiment will be described with reference to FIG. 6.

When the user cooks the food using the grill module 500, the users places the grill module 500 on the top surface of the top plate defining the top surface of the cooktop part 100.

When the grill module 500 is disposed on the top surface of the top plate, the user couples the collection device 600 to the coupling part 540 disposed on the grill module 500.

Here, when the control part 400 receives a signal for informing that the grill module 500 and the collection device 600 are not coupled to each other, an alarming sound is alarmed to allow the user to recognize that the grill module 500 and the collection device 600 are not coupled to each other.

Also, when the control part 400 receives a signal for informing that the grill module 500 and the collection device 600 are not coupled to each other, the heating source may not be operated even though the user manipulates the heating source disposed in the inner space of the cooktop part 100, thereby preventing the cooking appliance from being malfunctioned.

When the user couples the grill module 500 to the collection device 600, the detection part 620 transmits a coupling signal of the grill module 500 and the collection device 600 into the control part 400. When the control part 400 receives the coupling signal of the grill module 500 and the collection device 600, the user may manipulate the heating source disposed in the inner space of the cooktop part 100 to operate the heating source.

When the heating source disposed in the inner space of the cooktop part 100 is operated, the heating source generates fire. The fire and/or heat due to the fire may pass through the heating hole 150 and the opened bottom surface of the grill module 500 to heat the food disposed on the top surface of the module support member 500.

Various embodiments may be applied to the above-described cooking appliance. For example, although the exhaust hole 522 is defined in the rear surface of the grill module 500 in the embodiment, the exhaust hole 522 may be defined in the top surface of the grill module 500. Also, although the coupling part 540 includes the coupling projection 542 and the coupling groove 544, the coupling part 540 may be coupled through the other coupling method such as a method using a hook.

As described above, in the cooking appliance according to the embodiment, the food to be cooked may be directly and indirectly cooked.

Thus, since the foods are cooked using recipes different from each other at the same time, the cooking time for cooking the food may be reduced to satisfy the various needs of user.

Also, since the food to be cooked is directly heated, more delicious taste may be realized. Also, since the food in which fat is removed may take in, the health of the user may be improved.

Also, since the exhaust gas generated when the food is directly heated and cooked is collected by the collection device and exhausted by the exhaust device, it may prevent the kitchen space from being contaminated. Thus, since it prevents the kitchen space from being contaminated, the user may cook the food under the clean environment.

Furthermore, since the exhaust gas generated during the cooking of the food is completely exhausted, it may prevent the kitchen space from being contaminated and also prevent the user from being damaged.

As described above, in the cooking appliance according to the embodiment, the cooking appliance may cook the food through methods different from each other and also the food may be directly cooked.

Thus, since the foods are cooked using recipes different from each other at the same time, the food may be cooked through a recipe adequate for each food. Thus, the cooked food adequate for the user's taste may be provided.

Also, since the food is cooked through recipes from each other at the same time, the cooking time for cooking the food may be reduced.

As described above, due to the above-described advantageous, the production industry and distribution industry for producing and selling the cooking appliance may be sufficiently availability.

Also, since the various tastes of the user are satisfied, the cooking appliance may be available to the food industry or food service industry.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking appliance comprising:

a cooktop part on which a grill module for grill cooking is detachably disposed;

a collection device for sucking an exhaust gas generated in the grill module;

an exhaust device forcibly sucking the exhaust gas collected into the collection device to exhaust the exhaust gas to the outside; and a guide device for guiding the exhaust gas collected into the collection device to the exhaust device, wherein the grill module includes:

a module body defining an inner space and supporting the food;

a module cover for selectively opening or closing at least a top surface of the module body;

a coupling part for coupling the collection device to the module cover, the coupling part including a coupling projection provided on a rear surface of the module cover, and coupling grooves provided on the collection device for receiving the coupling projection therein; and a detection part disposed on the coupling part for detecting whether the collection device and the grill module are coupled to each other, wherein the module cover and the collection device are coupled to each other by the coupling part, with a predetermined distance between the module cover and the collection device.

2. The cooking appliance according to claim 1, wherein an exhaust hole providing a passage through which the exhaust gas is moved to an outer space of the grill module is defined in the grill module.

3. The cooking appliance according to claim 2, wherein the exhaust hole is selectively opened or closed.

4. The cooking appliance according to claim 1, wherein a module support member for supporting a food is disposed in an inner space of the grill module.

5. The cooking appliance according to claim 1, wherein the exhaust device is operated only when the collection device and the grill module are coupled to each other.

6. The cooking appliance according to claim 1, wherein the exhaust device is repeatedly operated so that the exhaust device is stopped for a preset time after the exhaust device is operated for a preset time.

7. A cooking appliance comprising:

a cooktop part comprising a grill module for heating a food placed on an upper portion thereof using a grill to cook the food;

an oven part disposed under the cooktop part to heat the food placed in an inner space thereof;

a drawer part disposed under the oven part to define a relatively low temperature space;

a collection device collecting an exhaust gas generated in the grill module; and an exhaust device exhausting the exhaust gas collected into the collection device to an outer space, wherein the grill module includes:

a module body defining an inner space and supporting the food;

a module cover for selectively opening or closing at least a top surface of the module body;

a coupling part for coupling the collection device to the module cover, the coupling part including a coupling projection provided on a rear surface of the module cover, and coupling grooves provided on the collection device for receiving the coupling projection therein; and a detection part disposed on the coupling part for detecting whether the collection device and the grill module are coupled to each other.

8. The cooking appliance according to claim 7, wherein a guide device for guiding movement of the exhaust gas is disposed between the collection device and the exhaust device.

9. The cooking appliance according to claim 7, wherein the grill module is selectively detached.

10. The cooking appliance according to claim 7, wherein the exhaust device is operated only when the collection device and the grill module are connected to each other.

11. The cooking appliance according to claim 7, wherein a heating hole providing a passage through which fire and/or heat pass(es) and is(are) moved toward the grill module is defined in a top surface of the cooktop part on which the grill module is disposed.

12. The cooking appliance according to claim 1, wherein a heating hole providing a passage through which fire and/or heat pass(es) and is(are) moved toward the grill module is defined in a top surface of the cooktop part on which the grill module is disposed.

* * * * *